United States Patent [19]

Cherry et al.

[11] 4,215,908

[45] Aug. 5, 1980

[54] ARCLESS CLAMP CONNECTOR

[75] Inventors: Raymond B Cherry, Dickinson; Leroy A. Bash, Sugarland, both of Tex.

[73] Assignee: Cathodic Protection Services, Inc., Houston, Tex.

[21] Appl. No.: 969,763

[22] Filed: Dec. 15, 1978

[51] Int. Cl.[2] ..... H01R 11/20

[52] U.S. Cl. ..... 339/96; 339/264 R

[58] Field of Search ..... 339/95 R, 96, 264

[56] References Cited

U.S. PATENT DOCUMENTS

| | | | |
|---|---|---|---|
| 2,700,141 | 1/1955 | Jones | 339/96 |
| 3,262,084 | 7/1966 | Armstrong | 339/96 |
| 3,853,385 | 12/1974 | Palazzetti et al. | 339/96 |
| 4,023,882 | 5/1977 | Pettersson | 339/96 |

*Primary Examiner*—Joseph H. McGlynn

*Attorney, Agent, or Firm*—Michael P. Breston

[57] ABSTRACT

The connector of this invention can make an arcless connection between an electric cable and a metallic object. The connector preferably is a C-clamp having a pair of opposed legs. One leg carries an adjustable clamp screw. The other leg carries a block of compressible, insulated, elastic material having a contact surface. At least one contact member has a portion thereof completely embedded in the block. The contact member has a sharply pointed tip adjacent to and facing the contact surface. By tightening the clamp screw against the metallic object, the clamping pressure will compress the block material until the pointed tip pierces the contact surface and establishes a forced electric connection between the contact member and the metallic object.

6 Claims, 10 Drawing Figures

FIG. 6.
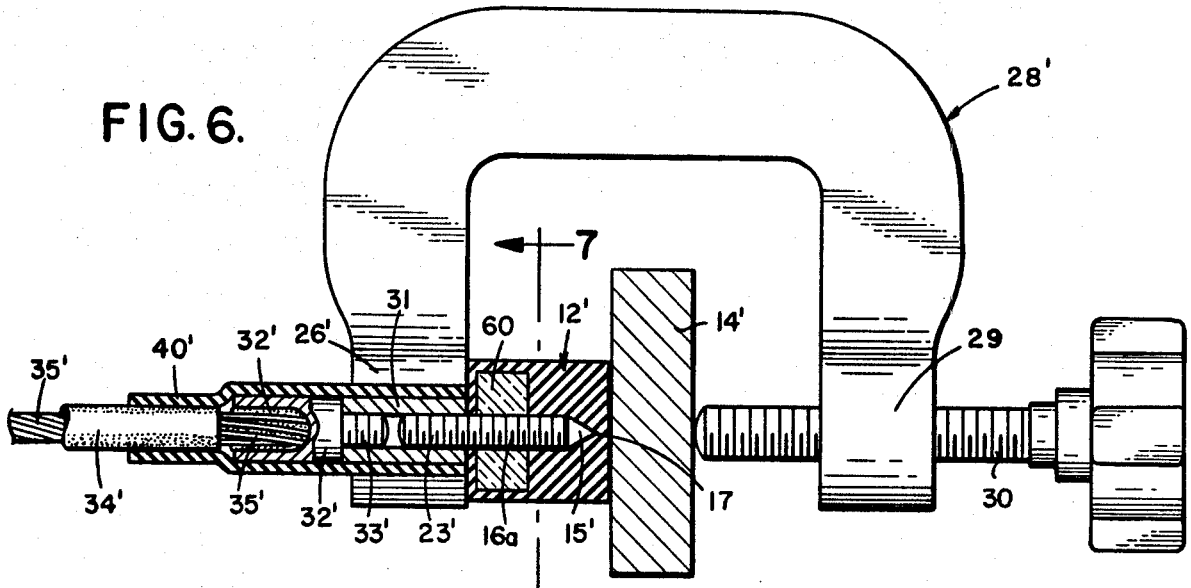
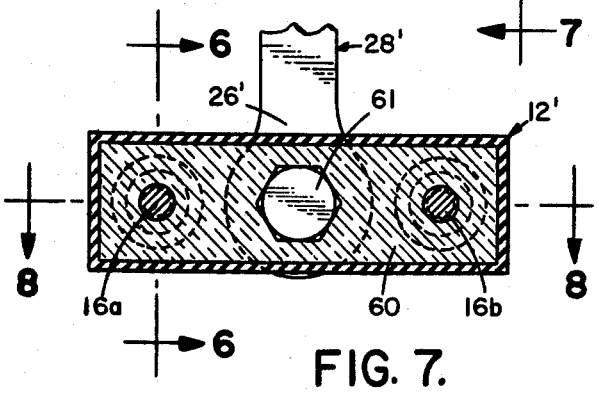
FIG. 7.
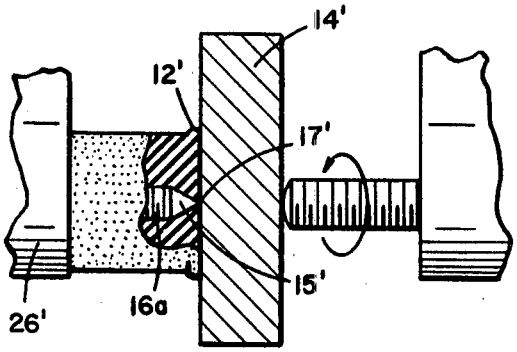
FIG. 9.
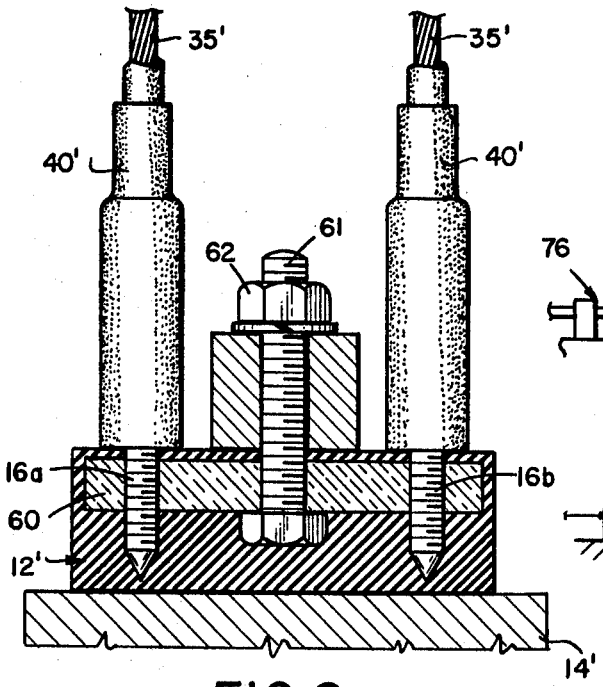
FIG. 8.
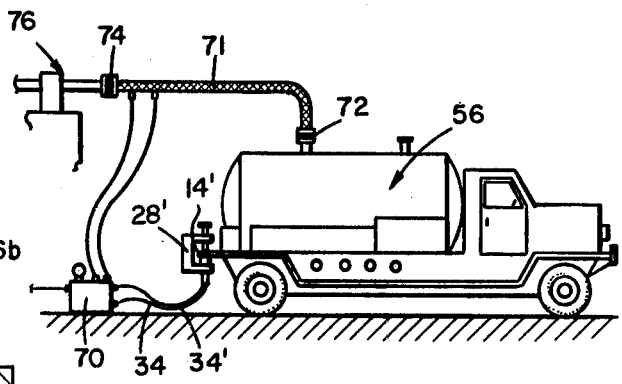
FIG. 10.

ARCLESS CLAMP CONNECTOR

BACKGROUND OF THE INVENTION

In many industries there is a need for an electric connector or switch capable of connecting an electric contact member to a metallic object without igniting combustible fluids which may surround the connector. For example, when explosive fuels, such as hydrocarbons, are pumped into or out of a metallic reservoir, such as a barge or truck tanker, the surrounding atmosphere is loaded with combustible fumes. It may happen that when a metallic object, external to such a reservoir, touches the reservoir there will be produced an arc that may ignite the explosive fumes.

Various attempts have been made to solve that problem. A method and system for protecting a barge is described in copending Patent Application Ser. No. 946,901, filed on Sept. 28, 1978, and assigned to the same assignee. The system for protecting the barge is illustrated in connection with the use of a metallic conduit for pumping hydrocarbon fluids into or out of the barge. The undesirable arcing can take place when the metallic conduit is connected to or disconnected from the barge.

The invention in said application involves connecting the barge to the earth through a barge-grounding cable, connecting the metallic conduit to the earth through a conduit-grounding cable, whereby a grounding circuit is established with a current source connected between the earth and the grounding cables.

The currents flowing through the grounding cables are being continuously monitored by an alarm circuit forming part of the grounding circuit in order to determine the presence and location of a broken cable or of an ineffective electric connection between the cable and the barge. The alarm circuit has suitable visual and audible warning devices which will indicate safe and dangerous operating conditions, as well as generally identify the location of faults.

As more fully explained in said application, the reason why arcing takes place when the metallic loading arms are connected to or disconnected from the barge is that both the barge and the loading arms are in a electrolytic circuit. When the loading arms are connected to the barge, electric current will flow because there is a potential difference therebetween, say on the order of 0.5 volts. Since the resistance in this electrolytic circuit is very small, a very large current can flow between the barge and the loading arms. This large current will produce arcing when the metallic loading arms first make contact with the barge.

As above-mentioned, the invention in said patent application relies on connecting a grounding cable to the barge. Such connection can be made through a C-clamp and an explosion-proof switch so that when arcing across the switch does occur, it will cause no damage.

The switch, in accordance with prior practice, must be contained within an explosion-proof housing. First, the C-clamp connects the grounding cable to the barge. Then the switch is turned ON. The resulting arcing, if any, produced between the contacts of the switch was completely contained within and confined to the inside of this explosion-proof housing.

Thus, the function of such a switch is to operate in combination with the C-clamp so as to allow the C-clamp to connect the grounding cable to the metallic body of the barge in such a manner that the arcing, if any there is produced, when the electric connection is established between the grounding cable and the barge, will be harmless to the explosive fumes in the immediate vicinity of the C-clamp and of the explosion-proof switch.

Thus, the propensity of the C-clamp to cause an explosion has been immobilized, in accordance with the prior art, by combining the C-clamp with an external explosion-proof switch.

It is an object of the present invention to provide an explosion-proof connector, in general, and a C-clamp, in particular, which does not require an external explosion-proof switch. Thus, the main difference between the prior art and the present invention resides in the elimination of the need for an explosion-proof switch externally of the C-clamp.

Thus, the expression "arcless connector" as used herein means a connector which can connect a metal object to an electric cable and which does not need an external explosion-proof switch. From the point of view of the explosive gases surrounding the connector of the present invention, it is as if the connector of the invention produced no arcing at all. The arcless connector and the inherent advantages thereof are illustrated by the novel structures of the embodiments of the invention.

SUMMARY OF THE INVENTION

In its broadest aspect, the arcless clamp connector comprises a block made of an elastic, compressible, insulating material having a contact surface. At least one electric contact member is embedded in the block adjacent to and facing the contact surface. The contact member is adapted to be connected to an electric cable. When the block material is not compressed, the electric contact is completely insulated by and embedded within the block material. When a metallic object is pressed against its contact surface, the block material will become compressed until the contact member pierces the contact surface and establishes an electric connection with the metallic object. The contact member remains completely insulated from the ambient environment prior to and after establishing the electric connection with the metallic object.

In one preferred embodiment of the arcless connector, there is provided a C-clamp having a pair of clamp legs. The block material is mounted on one leg facing the other leg on which is threadedly mounted a clamping screw. The contact member is continuously insulated from its clamp leg. A cable coupler, adapted to receive an electric cable, is connected to the contact member. The contact member is preferably a threaded bolt mounted on and secured to an insulating support, and the block material is molded over the outer portion of the threaded bolt which extends from the support. The molded block material either partially or completely covers the contact member support. The outer portion of the bolt has a conical shape and is terminated by a sharply pointed tip. The point of the tip lies near and faces the contact surface of the block material.

When a metallic object is clamped against the block, the point of the tip pierces the contact surface and establishes an electric connection with the metallic object. The compressed material of the block forms a fluid-tight seal around the thusly established electric connection, thereby containing any arcing, which may occur when the point of the tip first contacts the metallic object, within the insulating, compressible material of the block.

In another embodiment of the C-clamp of the present invention, a pair of spaced-apart bolts are embedded in the block of compessible material, and each bolt has a pointed tip, whereby two electric connections can be established with the clamped metallic object.

BRIEF DESCRIPTION OF THE DRAWINGS

FIG. 6 is a front view in elevation of another embodiment of the C-clamp connector of this invention with the block carrying two bolts; and the bolt-supporting clamp leg is shown partly in section and taken on line 6—6 in FIG. 7;

FIG. 7 is a sectional view on line 7—7 of FIG. 6;

FIG. 8 is a sectional view on line 8—8 of FIG. 7;

FIG. 9 is a fragmenary front view of FIG. 6 illustrating the established electric connections between the bolts and a metal lug clamped thereto; and FIG. 10 is a schematic representation of a monitoring system utilized to monitor the effectiveness of the electric connections shown in FIG. 9 established between the C-clamp connector shown in FIG. 6 and a truck tanker.

DETAILED DESCRIPTION OF PREFERRED EMBODIMENTS

Figure 1:
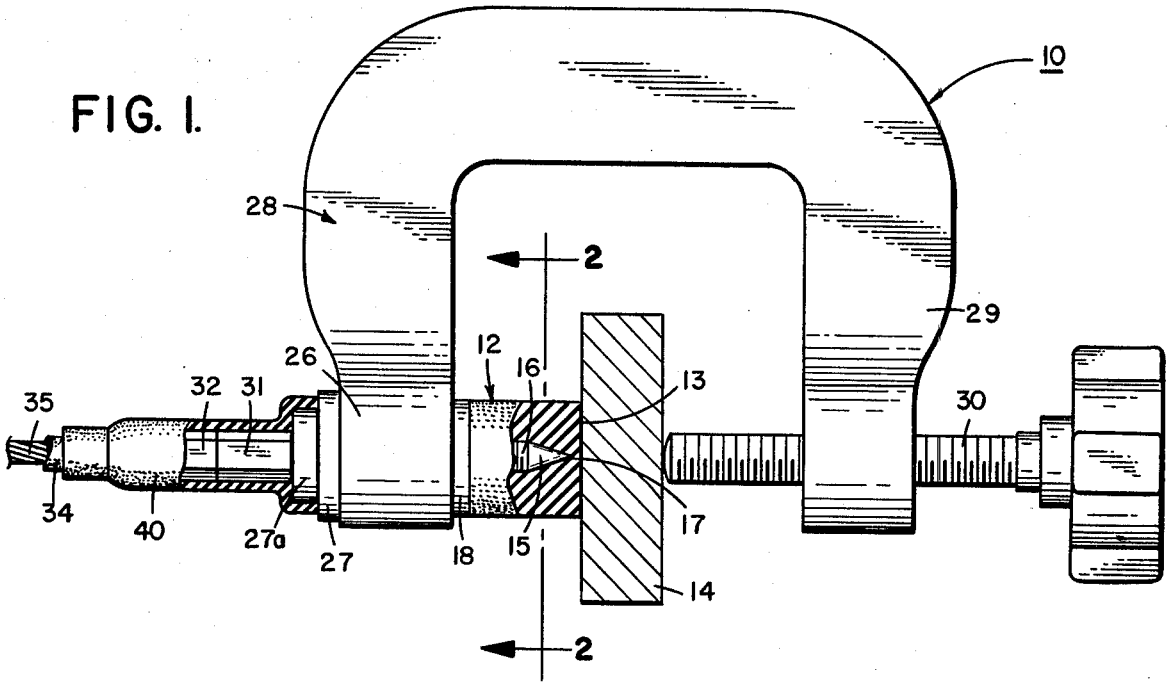
FIG. 1 is a front view in elevation, partly in section, of one embodiment of the C-clamp of the invention showing the compressible block in its normal, noncompressed state and with the bolt's tip insulated from a clamped lug.
Figure 3:
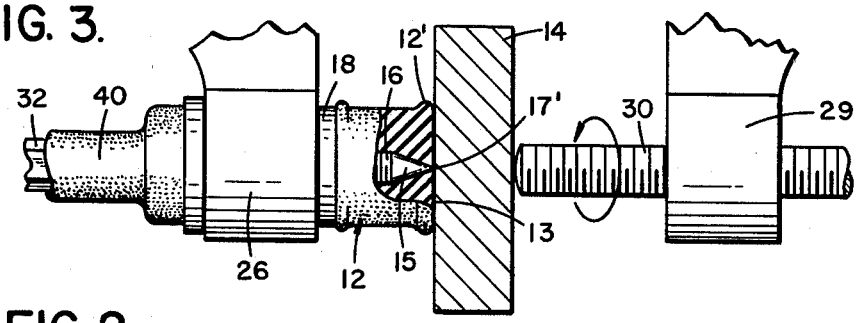
FIG. 3 is a fragmentary view of FIG. 1 illustrating the explosion-proof electric connection established between the metal lug and the tip of the bolt.
Figure 2:
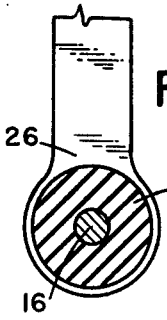
FIG. 2 is a view on line 2—2 of FIG. 1.
Figure 4:
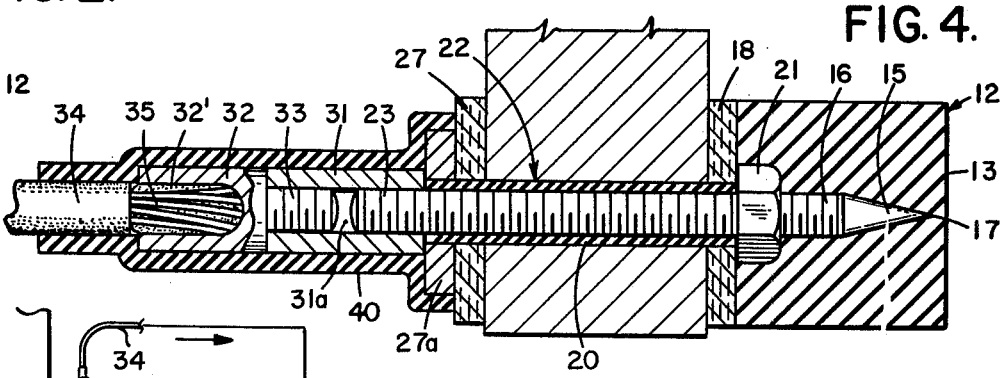
FIG. 4 is a fragmentary vertical sectional view of the bolt-supporting clamp leg, shown in FIG. 1.

In FIG. 1–4 is shown one embodiment of the invention illustrating an arcless or explosion-proof connector, generally designated as 10. Connector 10 serves as a switch to make or break an electric connection between two electric conductors. For that purpose there is provided a block 12 made of an elastic, insulating, compressible material. The block has a contact surface 13 which is to be clamped to a metallic object, such as a lug 14. The outer end 15 of a contact member, generally designated as 16, is completely embedded in the block 12. The contact member can have the shape of a threaded bolt 16 whose outer end 15 is a cone having a sharp tip or point 17 which is normally disposed near and facing the contact surface 13. The longitudinal axis of bolt 16 is preferably perpendicular to contact surface 13. A threaded member or nut 21 (FIG. 4) locks bolt 16 to an insulating disc 18 having a center bore to accommodate disc 18. The majority of the length of bolt 16 to the left of nut 21, as viewed in FIG. 4, is covered with an insulating sleeve 20, except that the innermost end portion 23 of bolt 16 is not covered by sleeve 20. The block 12 can have any suitable configuration, such as cylindrical, and can be molded over the insulating disc 18, nut 21, and outer end 15 of bolt 16. Thus, the block 12, bolt 16, disc 18, nut 21, and insulating sleeve 20 form a unitary subassembly, generally designated as 22.

The sub-assembly 22 is mounted on a support which can assume various configurations. In the preferred embodiment, the support is one leg 26 of a C-clamp, generally designated as 28, which has another leg 29 through which is threaded a clamp screw 30.

The insulated section of bolt 16 extends through leg 26 and is supported by an insulating washer 27 and by a steel washer 27*a*. The innermost end portion 23 of bolt 16 is threadedly received by an internally threaded coupling sleeve 31 at one end thereof. A threaded pin 33 of an adapter plug 32 is threadedly received by the coupling 31 at the other end thereof. Pin 33 is preferably separated from end portion 23 by a space 31*a*.

An electric cable 34 having one or more conductors 35 is received by and soldered to the socket 32′ of plug 32. The threaded coupling 31 is tightened on the inner end 23 of bolt 16 thereby applying pressure on the metal washer 27*a*, so that sub-assembly 22 is securely fastened to the other side of clamp leg 26. The adapter plug 32, threaded coupling 31, and steel washer 27*a* are covered by an insulating jacket 40.

In use, clamp screw 30 clamps lug 14 to block 12 by rotating the screw clockwise (FIG. 3), thereby compressing axially the block material until tip 17 pierces the contact surface 13 and makes a forced electric connection 17′ with lug 14. The compressed portion 12′ of block 12 becomes enlarged in diameter and forms an effective seal around connection 17′ (FIG. 3). The established electric connection 17′ is completely isolated from the ambient fluids which may contain explosive gases. Such isolation is effective prior to, during, and after the electric connection is established.

It will be appreciated that, with the construction of the C-clamp as so far described, even if cable 34 carried current, that current would be insulated from the body of the C-clamp. Typically, the C-clamp 28 and clamp screw 30 are made of bronze. In this manner, no arcing can take place when the C-clamp is thrown around, as on the steel decks of a tanker barge.

Figure 5:
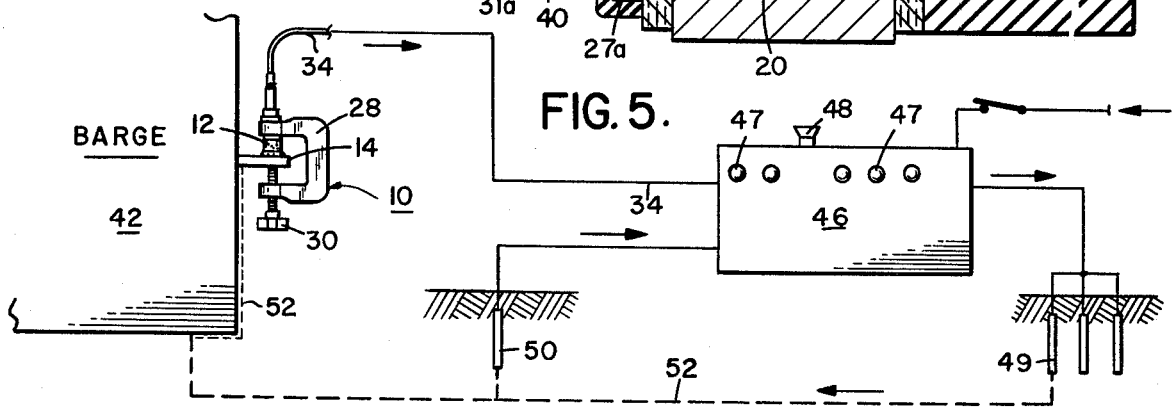
FIG. 5 is a schematic representation of a monitoring system utilized to monitor the effectiveness of the electric connection established between the C-clamp connector and a barge.

The C-clamp 28 is illustrated in FIG. 5 as being connected to a projecting metal lug 14 of a tanker barge 42.

In said copending patent application, there is shown a method of protecting the fuel-carrying barge 42 by grounding its lug 14 through cable 34. Cable 34 forms part of a monitoring system 46 having warning lights 47 and an audible horn 48. The monitoring system 46 is grounded to the earth through rods 49 and 50. The rods are in an electrolytic circuit indicated by the broken lines 52 so that current can flow through lug 14 when the C-clamp connector 28 establishes a proper electric connection 17′ between the tip 17 and the lug 14 (FIG. 3). This clamping action is achieved by turning the clamp screw 30 in a clockwise direction. Block 12 will compress and tip 17 will pierce the block's contact surface 13 and make the electric connection 17′ which is sealed off from the ambient medium by the enlarged compressed block portion 12′.

Since the electric resistance in the electrolytic circuit 52 is very small, a very large current can flow through tip 17 of the C-clamp when it is clamped to the lug 14 of the barge. Even if such large current were to produce arcing at tip 17, such arcing would be completely contained within the block material 12 and, therefore, would not cause the explosive fluids carried by the barge 42 to ignite.

The monitoring system 46 continuously monitors the effectiveness of the electric connection 17' between the C-clamp and the lug 14 of the barge. The conditions being monitored are indicated by the visual and audible warning devices 47, 48.

After the barge 42 is loaded with its fuel cargo, the grounding C-clamp 28 is disconnected from the barge by rotating the clamp screw 30 counter-clockwise, as viewed in FIG. 3, and such rotation will cause the compressed block portion 12' to return to its original uncompressed, reduced-diameter position, as shown in FIG. 4, thereby completely resealing the tip 17 within the block material 12.

With reference to FIGS. 6–9 there is shown a modified embodiment of a C-clamp 28' for grounding a truck tanker 56. To facilitate the description of this clamp embodiment, the same numerals will be used to reference the same parts, and similar parts will be referenced with the same numerals followed by a prime (').

In C-clamp 28', the compressible block 12 carries two spaced-apart bolts **16*a*, 16*b* which extend through a fiberglass plate 60 that is completely embedded inside the block material 12 together with a threaded anchor bolt 61. Bolt 61 is sufficiently long so that it will extend through the clamp leg 26 and become secured thereto by a nut 62. Otherwise, the construction of the C-clamp 28' is similar in its important respects to the construction of the C-clamp 28, shown in FIGS. 1–4. It will be noted that washers 27, 27*a* are eliminated from the modified C-clamp embodiment 28'.**

In use, the C-clamp 28' is connected to the body of the truck tanker 56 for connecting two cables 34, 34' to a grounding and monitoring network 70 and thence to a braided, flexible, metallic hose 71 having one flange 72 connected to the truck tanker 56 and another flange 74 connected to a conduit of a loading dock 76.

Thus, the improved C-clamp of this invention safely connects one or more electric cables to metallic objects without exposing the established electric connection or connections 17' to the ambient medium. This is achieved by embedding the electric contact members in an elastic compressible, insulating material 12 which serves to continuously protect the electric contact members 17 from touching a metal object and to perform an effective seal around the electric connections established between the electric contact members and the metal object clamped thereto. Upon unclamping the C-clamp from the metal object, the elasticity of the compressible material will cause it to return to its original shape and to reseal the electric contact member.

In the preferred embodiment, the compressible material was molded from virgin, oil and weather resisting neoprene having the following properties:

TABLE A

| | | |
|---|---|---|
| hardness | 55–60 | durometer Shore A |
| compression set | 20–25% | (ASTM D 395–69 test) |
| tensile strength | 2000 psi | (ASTM D 1456–61) |
| specific gravity | 1.4 | |

Other materials of similar characteristics can also be used.

We claim:

1. An arcless clamp connector comprising:

a block made of an elastic, compressible, insulating material and having a contact surface, at least one electric contact member embedded in said block adjacent to and facing said contact surface, a clamp having a body carrying said block, said body being C-shaped and having a pair of opposed legs, said block being mounted on one leg facing the other leg, and clamping means mounted on said other leg for clamping said block to an electric conductor member, whereby the clamping pressure of said clamping means compresses said material until said contact member pierces said contact surface and establishes a forced electric connection between said conductor member and said electric contact member, and said compressed material sealing off said electric connection from the ambient medium.

2. The clamp connector of claim 1 wherein said clamping means is a clamp screw.

3. The clamp connector of claim 1 and means insulating said contact member from the body of said clamp, and a cable coupler means connected to said contact member for receiving an electric cable therein.

4. The C-clamp connector of claim 3 wherein said contact member is a threaded bolt, and said cable coupler means includes:

an internally threaded sleeve for receiving said threaded bolt at one end thereof.

5. The C-clamp of claim 4 wherein said cable coupler means further includes:

a plug having a socket for receiving said cable and a threaded pin, and said sleeve threadedly receiving said pin at the other end thereof.

6. A C-clamp having a pair of clamp legs for making an arcless connection between at least one electric cable and a metallic object, one clamp leg carrying a block of compressible, insulated material, a contact member having one end provided with a sharply pointed tip completely embedded in said block, and the other clamp leg carrying an adjustable clamp screw.

* * * * *